United States Patent [19]

Smashey

[11] 4,178,986

[45] Dec. 18, 1979

[54] FURNACE FOR DIRECTIONAL SOLIDIFICATION CASTING

[75] Inventor: Russell W. Smashey, Albuquerque, N. Mex.

[73] Assignee: General Electric Company, Cincinnati, Ohio

[21] Appl. No.: 892,434

[22] Filed: Mar. 31, 1978

[51] Int. Cl.[2] ..... B22D 25/00; B22D 27/04

[52] U.S. Cl. ..... 164/251; 164/60; 164/338 R

[58] Field of Search ..... 164/60, 66, 68, 133, 164/338 M, 338 H, 125, 126, 128, 127, 251; 13/27

[56] References Cited

U.S. PATENT DOCUMENTS

| | | | |
|---|---|---|---|
| 2,171,778 | 9/1939 | Yantis | 164/68 |
| 2,877,280 | 3/1959 | Eden | 13/27 |
| 3,435,878 | 4/1969 | Howard et al. | 164/66 |
| 3,484,840 | 12/1969 | Spoth et al. | 13/27 |
| 3,538,981 | 11/1970 | Phipps, Jr. | 164/60 |
| 3,584,676 | 6/1971 | Busquet | 164/60 |
| 3,677,332 | 7/1972 | Smiernow | 164/133 |
| 3,712,364 | 1/1973 | Daniel et al. | 164/66 |
| 3,770,047 | 11/1973 | Kirkpatrick et al. | 164/60 |
| 3,847,203 | 11/1974 | Northwood | 164/60 |
| 3,895,672 | 7/1975 | King, Jr. et al. | 164/127 |
| 3,897,815 | 8/1975 | Smashey | 164/60 |

*Primary Examiner*—Robert D. Baldwin
*Assistant Examiner*—K. Y. Lin
*Attorney, Agent, or Firm*—Lee H. Sachs; Derek P. Lawrence

[57] ABSTRACT

A directional solidification melting and self-casting apparatus is improved through the provision of a multi-zoned, self-casting furnace including the combination of an induction heated, insitu charge melting upper zone and a resistance heated lower zone.

1 Claim, 1 Drawing Figure

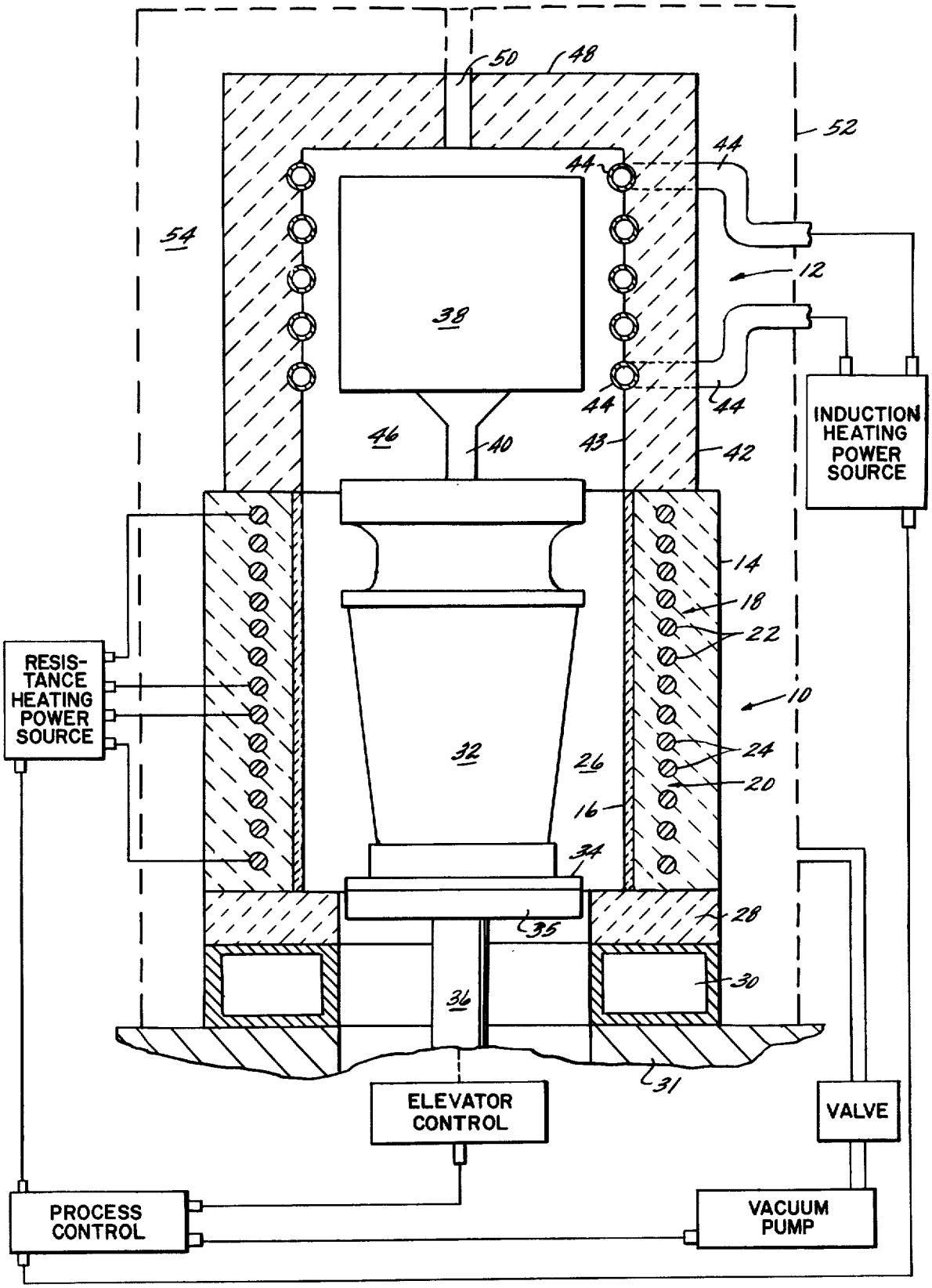
50
48
52
44
44
54
12
38
44
44
INDUCTION HEATING POWER SOURCE
46
40
43
42
14
18
22
RESIS-TANCE HEATING POWER SOURCE
10
32
26
24
20
16
34
28
35
30
36
31
ELEVATOR CONTROL
VALVE
PROCESS CONTROL
VACUUM PUMP

FURNACE FOR DIRECTIONAL SOLIDIFICATION CASTING

FIELD OF THE INVENTION

This invention relates to casting apparatus and, more particularly, to an enclosed melting and self-casting furnace useful in directional solidification casting of metal articles.

BACKGROUND OF THE INVENTION

The unidirectional solidification form of the precision investment casting method has been the subject of significant effort in connection with the manufacture of blades and vanes for the turbine section of gas turbine engines. It has been recognized that certain mechanical properties, such as thermal fatigue life, can be improved in the elongated grained or single crystal structures which can be provided by such a method.

Because high temperature superalloys generally are used in the manufacture of such turbine blades and vanes, a wide variety of directional solidification apparatus has incorporated an approach used in the conventional precision casting of such alloys. Such approach involves first melting a charge in a crucible or pour cup and then pouring the molten charge into a mold, all within a heated, vacuum enclosure. This type of method and apparatus is described in such patents as U.S. Pat. Nos. 3,538,981—Phipps, Jr., 3,770,047—Kirkpatrick et al and 3,847,203—Northwood. As is shown in such typical structure, it is common in the pour casting method to use induction heating coils for the application of heat to the mold area or to the crucible for melting of the charge prior to pouring.

Another form of a directional solidification apparatus and method is described in U.S. Pat. No. 3,897,815—Smashey, the disclosure of which is incorporated herein by reference. The Smashey patent, in the embodiment shown in its drawing, describes an enclosed, self-casting type furnace for use in the directional solidification method. In that form, a plurality of heating elements are arranged in a substantial vertical array to heat the furnace chamber in order to control features of the withdrawal method of directional solidification to which that Smashey patent relates.

The present invention, which relates to apparatus of the enclosed, self-casting directional solidification type, employs a refractory mold which includes an upper charge melting cup connected to a lower article casting portion to allow flow of molten charge into such lower portion of the mold. Such a mold is described in U.S. Pat. No. 4,044,815—Smashey et al, the disclosure of which is incorporated herein by reference.

Although the prior art has described a variety of methods and apparatus for use in the directional solidification casting of metal articles, the casting of relatively large articles, for example of about two pounds or more, either has required the separate charge melting and then pouring of molten metal into a mold or has required inordinately long periods of time for resistance furnace melting. As was mentioned before, using the melt-and-pour technique, the charge commonly is melted by induction heating and then poured into the mold cavity by tilting a melt ladle to allow liquid metal to run into the mold. While basically a simple procedure, this process has several serious deficiencies.

One problem is that the melt and pouring ladle is a major source of ceramic-type contamination of the metal being cast. Such contamination eventually is reflected in the form of ceramic inclusions in the finished casting.

A serious problem relates to the pouring of liquid metal into the top of a mold in an enclosure heated by a resistance wound furnace, which is desirable for close control of the solidification portion of the process. Mechanically, it is difficult to direct the entire liquid metal stream continually through the relatively small opening in the top of the mold. As a result, some molten metal invariably is cast onto the furnace internal structure. This can create furnace electrical shorts caused by spattering onto the resistance heating coils. In addition, such misdirected metal, which adheres to the outer portions of the mold, can cause interference of the mold with other furnace portions when the mold is lowered in the withdrawal process.

Another problem associated with the melt-and-pour technique is the difficulty of control of liquid metal superheat prior to pour. In such technique, superheat temperature is measured through an optical pyrometer directed onto the surface of the liquid metal bath through a viewing port or by immersion thermocouple probes. However, error is introduced into such measurement through the formation of slag on the surface being measured and metal vapor collecting on the viewing port, and by mechanical manipulation and insulation problems associated with the immersion probe. Therefore, it becomes difficult to obtain a meaningful temperature reading of the liquid metal bath.

SUMMARY OF THE INVENTION

It is a principal object of the present invention to provide an improved directional solidification self-casting apparatus of the withdrawal type through the provision of a furnace including rapid heating means in an upper zone intended to surround the charge cup of a self-casting mold and a slower heating means in a lower zone intended to surround an article casting portion of the mold.

This and other objects and advantages will be more fully understood from the following detailed description, the drawings and the specific examples, all of which are intended to be typical of rather than in any way limiting on the scope of the present invention.

One form of the present invention is included in a directional solidification melting and self-casting apparatus having a furnace portion with which is associated means to maintain desired atmosphere conditions within the furnace portion and means to move a self-casting mold into and out of the furnace portion, the furnace portion being of the multi-zone and enclosed type for insitu charge melting and self-casting. The present invention comprises, in combination, a resistance heated lower zone and an induction heated upper zone communicating with the lower zone. The lower zone is a directional solidification casting furnace of the type shown in the above-incorporated Smashey U.S. Pat. No. 3,897,815 and which is resistance heated above a stationary, peripherally disposed chill and a peripherally disposed radiation baffle. The upper zone comprises upper walls having an inner surface enclosing an upper hollow interior intended to surround the charge cup of a self casting type mold. Carried at the inner surface of the upper walls is an open bottom induction heating coil about the periphery of the upper hollow interior to provide a close couple with a metal charge to be melted in the charge cup. The furnace includes a top member disposed across the upper walls and the upper hollow interior to define an upper boundary of the hollow interior.

BRIEF DESCRIPTION OF THE DRAWING

The drawing is a fragmentary, sectional, diagrammatic view of one form of the furnace of the present invention.

DESCRIPTION OF THE PREFERRED EMBODIMENT

In the drawing of the above-incorporated Smashey U.S. Pat. No. 3,897,815, and in its associated description, there is disclosed a multi-zone furnace into which a self-casting, precision casting mold can be placed. Such placement can occur using a vertically movable platform, conveniently carrying a movable chill such as of the water-cooled type. For ease in manufacture, such furnaces generally are circular in cross section.

Referring to the drawing of the present application, which is a sectional, diagrammatic view of one form of the furnace of the present invention, a lower zone is shown generally at 10 and an upper zone is shown generally at 12. The lower zone, typical of known resistance heated furnaces used for directional solidification of castings, includes refractory walls 14 within which is an alumina tube 16 forming the furnace lining. In this particular embodiment, the lower zone 10 is divided into two zones indicated generally at 18 and 20, each including resistance wire windings 22 and 24, respectively. Each zone is controlled separately, as described in the above-incorporated Smashey patent and in the drawings of this application, for the purpose of controlling the solidification front as the cast metal is cooled. Thus, resistance heated walls 14 and the inner surface of furnace lining 16 of the lower furnace zone 10 define lateral boundaries of lower hollow interior 26 of the furnace.

As is common in the art, lower furnace zone 10 is mounted on a circumferentially disposed radiation baffle 28 of refractory material to assist in confining heat within the furnace and away from a circumferentially disposed stationary chill 30 below the radiation baffle. Such a chill generally is water cooled and is carried by a base plate 31. The chill is intended to withdraw heat from casting mold portion 32 during withdrawal of the mold from the furnace lower zone 10. Thus, the resistance heated lower furnace zone 10 surrounds casting mold portion 32 in which the article is intended to be directionally solidified. Mold 32 is mounted on a platform 34 such as is associated with movable chill 35, centrally disposed in respect to interior 26 and adapted to be movable vertically. In this way, mold 32 is moved into and out of the furnace hollow interior. Such movement can be accompanied, as described in the above-incorporated Smashey patent, using shaft 36 driven by a conventional motor, not shown.

A self-casting, ceramic mold, such as is shown in the drawing and intended for insitu charge melting, includes a ceramic charge or melt cup 38 operatively connected to casting mold portion 32 to allow molten metal to fill the mold cavity without resorting to pour-type casting. As shown in the drawing, and as is described in the above-incorporated Smashey et al U.S. Pat. No. 4,044,815, the melt cup is connected to the casting mold through a passage such as 40 in the drawing. A fuse plug, sometimes used in the art, is placed in passage 40 to control the casting temperature and molten metal superheat of the metal being melted in melt cup 38. The material of such a fuse plug is selected for its compatibility with the metal being melted and for its melting temperature in order to control to a desired amount of superheat the temperature of the molten metal prior to casting into the cavity of mold portion 32.

In the manufacture of large castings, for example requiring two or more pounds of material, it has been found that using conventional resistance heated charge melting furnaces for insitu melting and casting requires inordinately long periods of time. Therefore, resistance heating is a relatively slow heating means for large charges. This is particularly true when it is desired to attain the desired amount of superheat as controlled by the melting temperature of the fuse plug. The following table presents typical examples of charge weights and times required to melt such charge which, in this example, was made of typical nickel-base superalloys of the type commonly used to cast modern gas turbine engine blades, using known resistance wound furnaces.

TABLE

| RESISTANCE WOUND FURNACE | | |
|---|---|---|
| EXAMPLE | CHARGE WT. (grams) | MELT TIME (min.) |
| 1 | 120 | 10 |
| 2 | 145 | 15 |
| 3 | 420 | 18 |
| 4 | 430 | 19 |
| 5 | 660 | 30 |
| 6 | 1135 | 180+ |

In Example 6, in which the casting required about two and one-half pounds of metal per casting, in excess of three hours was needed to melt the metal charge using resistance heating. In addition, the yield from such large, relatively heavy casting was less than 5% using such conventional resistance wound furnace, the designs and operating parameters of which were adjusted in an attempt to maximize efficiency. Use of pour-type furnaces and methods was avoided in connection with such resistance wound furnaces for the reasons discussed above.

According to the present invention, an improvement in the self-casting type directional solidification melting and casting furnace was made through the combination of an open bottom induction coil-heated upper furnace charge melting zone communicating directly with a resistance-heated lower furnace zone for control of the metal cast into the mold. In the drawing, such upper zone 12 includes refractory walls 42 having an inner surface 43 which carries about the inner periphery of wall 42 an induction heating coil 44 powered and water-cooled in a conventional manner, for example by a 25 kilowatt unit of a type commercially available. Coil 44 is positioned to surround in close proximity the lateral portions of melt cup 38 in order to provide a close couple with the charge to be placed in melt cup 38. Placement of coils 44 at the inner surface 43 of refractory walls 42 rather than within the walls or outwardly of the walls, as sometimes shown in the prior art, significantly reduces the power and the time required to melt the metal charge placed within melt cup 38. Surface 43 of walls 42 defines the lateral boundary of furnace upper hollow interior 46 which is substantially coextensive with lower hollow interior 26 of the lower zone. In the embodiment of the drawing, inner surface 43 of the upper zone and the inner surface of furnace lining 16 of the lower zone define a substantially continuous inner furnace wall which provides the lateral boundary of the furnace hollow interior. Defining the upper boundary of the furnace hollow interior is a refractory top portion 48 on walls 42. If desired, a sealed viewport 50 in top 48 can be provided to allow observation that a charge, melted in cup 38, has dropped from the cup as a result of the subsequent melting of a fuse plug placed in passage 40. Of course, a variety of means can be used to determine such molten metal movement.

As shown by the above-incorporated Smashey U.S. Pat. No. 3,897,815, the furnace is conveniently placed within an enclosure, shown in phantom at 52. The enclosure allows for the provision of vacuum or any desired atmosphere within the interior 54 of enclosure 52 and within the furnace hollow interiors 26 and 46. Because of the porosity of the refractory from which such furnaces are constructed, a vacuum is easily provided and generally is used for the self-casting of Ni and Co base superalloys of the type used in gas turbine engine blades and vanes.

In operation of the furnace of the present invention, a fuse plug and desired metal charge are placed in the passage 40 and melt cup 38, respectively, of the mold. The mold is then placed in the directional solidification apparatus, as described in the above-incorporated Smashey patent. After sealing the apparatus and providing a predetermined internal atmospheric condition, such as a vacuum, the mold is then moved into position as shown in the drawing of the present application. In such position, melt cup 38 is positioned within and closely surrounded by induction heating coil 44 carried at surface 43 of walls 42 and lower mold portion 32 is positioned within the resistance heated furnace lining 16.

At the start of the insitu melting and self-casting procedure, full power is applied to induction heating coils 44 for rapid melting of the charge within cup 38 and to achieve the preselected superheat as controlled by the melting point of the fuse plug. In some example evaluations using the present invention, five-pound charges of a nickel-base superalloy and of a cobalt-base superalloy were melted and self cast, in separate evaluations, in less than five minutes each using a 25 kilowatt induction coil. Reference to the above table shows the distinct advantage of the present invention over known self-casting type directional solidification furnaces.

As a result of the present invention, the previous article size restrictions for practical manufacture using insitu casting, resistance heated, directional solidification furnaces have been eliminated from directional solidification processing, thus to result in a significant cost reduction in such manufacture. Although the present invention has been described in connection with specific examples and embodiments, it will be recognized by those skilled in the art the variations and modifications of which the present invention is capable within its scope as defined by the appended claims.

What is claimed is:

1. In a directional solidification melting and self-casting apparatus of the withdrawal type including a furnace, means to supply electric power to the furnace, means to control the electric power to control heat within the furnace, means to move a mold into and out of the furnace and means to maintain desired atmospheric conditions within the apparatus, the furnace being of a multi-zone, enclosed, insitu charge melting and self-casting type comprising, in combination:

a resistance heated zone; and an induction heated zone;

the resistance heated zone being a directional solidification casting furnace including:

(a) resistance heated walls having an inner surface which defines a lateral boundary of a resistance heated hollow interior, (b) a stationary chill disposed peripherally substantially vertically beneath said walls, (c) a peripherally disposed radiation baffle disposed between said walls and said stationary chill, and (d) a platform disposed axially within the apparatus and movable vertically and adapted to carry a casting mold into which molten metal is disposed;

the improvement wherein:

the induction heated zone is disposed above, aligned with and communicates directly with the resistance heated zone to define the resistance heated zone as a lower zone and the induction heated zone as an upper zone, the upper zone including:

(a) upper walls having an inner surface enclosing an upper hollow interior substantially vertically aligned and coextensive with the resistance heated hollow interior and carrying at said inner surface an open bottom induction heating coil about the periphery of the upper hollow interior the inner surface of the resistance heated walls and the inner surface of the upper walls defining a substantially continuous inner furnace wall adapted to be in close proximity to lateral walls of the casting mold carried by the platform, and (b) a furnace top member disposed across the upper walls and upper hollow interior to define an upper boundary of the hollow interior.

* * * * *